US005700086A

United States Patent [19]

Forslund

[11] Patent Number: 5,700,086

[45] Date of Patent: Dec. 23, 1997

[54] MIXING DEVICE WITH AXIALLY MOVABLE SHAFT FOR MAINTENANCE PURPOSES

[75] Inventor: Kjell Forslund, Sundsbruk, Sweden

[73] Assignee: Sunds Defibrator Industries AB, Sweden

[21] Appl. No.: 552,273

[22] Filed: Nov. 2, 1995

[30] Foreign Application Priority Data

Nov. 3, 1994 [SE] Sweden ..... 9403761

[51] Int. Cl.[6] ..... B01F 7/00

[52] U.S. Cl. ..... 366/172.2; 366/286; 366/331

[58] Field of Search ..... 366/65, 279, 168.1, 366/172.2, 262–265, 285, 286, 289, 314, 331; 162/57, 243; 416/205, 244 R, 246

[56] References Cited

U.S. PATENT DOCUMENTS

| | | | |
|---|---|---|---|
| 254,157 | 2/1882 | Roat | 366/286 |
| 2,239,152 | 4/1941 | Jacobsen | 366/286 X |
| 4,384,788 | 5/1983 | Lenart et al. | 366/314 |
| 4,396,160 | 8/1983 | Reinecker et al. . | |
| 4,511,255 | 4/1985 | Saucier | 366/286 X |
| 4,746,400 | 5/1988 | Sherman et al. | 162/57 X |
| 4,834,549 | 5/1989 | Taniguchi et al. | 366/286 |
| 5,358,332 | 10/1994 | Derksen et al. | 366/286 |

FOREIGN PATENT DOCUMENTS

| | | | |
|---|---|---|---|
| 85164 B | 11/1991 | Finland . | |
| 158114 | 1/1933 | Switzerland | 366/286 |
| WO 94/00227 | 1/1994 | WIPO . | |

*Primary Examiner*—Charles E. Cooley

*Attorney, Agent, or Firm*—Lerner, David, Littenberg, Krumholz & Mentlik

[57] ABSTRACT

Apparatus for mixing a processing medium with a pulp suspension within a vessel is disclosed, including a housing attached to a wall of the vessel, a rotary shaft extending into the vessel through an opening in the housing, bearings supporting the rotary shaft within the housing, seals for sealing the rotary shaft within the housing, a propeller with a hub attached to the rotary shaft within the vessel, the hub including an extending portion adapted to sealingly engage the opening in the housing, the rotary shaft being axially movable between a normal operating position in which the hub and the opening in the housing are separated by a gap and a sealed position in which the gap is closed and the extended portion of the hub sealingly engages the opening in the housing, and a locking ring for locking the rotary shaft in its sealed position whereby the housing is accessible while the vessel remains filled with the suspension.

16 Claims, 2 Drawing Sheets

MIXING DEVICE WITH AXIALLY MOVABLE SHAFT FOR MAINTENANCE PURPOSES

FIELD OF THE INVENTION

The present invention relates to a device for admixing a processing medium to a pulp suspension in a vessel. More particularly, the present invention relates to such a device in which the processing medium can consist of liquids and chemicals, substantially in the fluid state, for dilution or other forms of processing.

BACKGROUND OF THE INVENTION

In connection with the mixing of a processing medium with suspensions, such as a pulp suspension, the processing medium is usually admixed with the suspension in the lower portion of a pulp vessel. The mixing device generally comprises a rotary shaft with a propeller, which accelerates the pulp to a high speed through a nozzle, whereby the surrounding pulp is sucked into the propeller. The processing medium is supplied to the mixing device in order to obtain effective admixing.

In such devices the propeller shaft is normally supported in bearings located in a housing, which is intended to be attached to the vessel wall. Within the housing, seals are provided on the shaft in order to prevent the contents of the vessel, as well as the processing medium, from leaking out. In order to shorten the downtime during the exchange of bearings and seals, it is desired to carry out these changes without first emptying the vessel. The present invention provides a simple and effective design of the mixing device whereby the exchange of bearings and seals can be carried out while the vessel is still in its filled state. The device can also be cleaned at the same time.

SUMMARY OF THE INVENTION

In accordance with the present invention, these and other objects have been accomplished by the discovery of an apparatus for mixing a processing medium with a suspension contained in a vessel comprising a housing adapted for attachment to a wall of the vessel, the housing including an opening, a rotary shaft extending through the opening in the housing into the vessel, bearing means supporting the rotary shaft within the housing, sealing means for sealing the rotary shaft within the housing, a propeller including a hub attached to the rotary shaft within the vessel, the hub including a sealing portion adapted for sealingly engaging the opening in the housing, the rotary shaft being axially movable between a normal operating position wherein the hub and opening in the housing are separated by a gap and a sealed position wherein the gap is closed and the sealing portion of the hub sealingly engages the opening of the housing, and locking means for locking the rotary shaft in the sealed position whereby the housing is accessible while the vessel remains filled with the suspension. In a preferred embodiment, the suspension is a pulp suspension.

In accordance with one embodiment of the apparatus of the present invention, the housing includes processing medium supply means for supplying the processing medium to the gap. Preferably, the processing medium supply means includes a supply chamber surrounding the rotary shaft and adjacent to the opening in the housing.

In accordance with another embodiment of the apparatus of the present invention, the bearing means includes front bearing means proximate to the opening in the housing and rear bearing means distal to the opening in the housing. In a preferred embodiment, the rear bearing means is axially movable within the housing along with the rotary shaft. Preferably, the rear bearing means includes rear bearing holding means for mounting the rear bearing means, the rear bearing holding means being axially movable with the rear bearing means.

In another embodiment of the apparatus of the present invention, the sealing portion of the hub and the opening in the housing include corresponding sealing surfaces, whereby when the rotary shaft is in the sealed position, the corresponding sealing surfaces assist in centering the rotary shaft within the housing.

In accordance with another embodiment of the apparatus of the present invention, the locking means comprises a separate locking element. Preferably, the separate locking element comprises a split cylindrical ring for guiding and locking the rotary shaft whereby the separate locking element can support the rotary shaft in place of the bearing means when the rotary shaft is in the sealed position.

In accordance with another embodiment of the apparatus of the present invention, the processing medium supply means includes a valve whereby the supply means can be cleaned and the supply chamber can be evacuated so that the tightness of the seal between the sealing portion of the hub and the opening in the housing can be controlled.

BRIEF DESCRIPTION OF THE DRAWINGS

The nature and substance of the present invention may be more fully understood with reference to the following detailed description, which refers, in turn, to the accompanying Figures in which.

DETAILED DESCRIPTION

Figure 1:
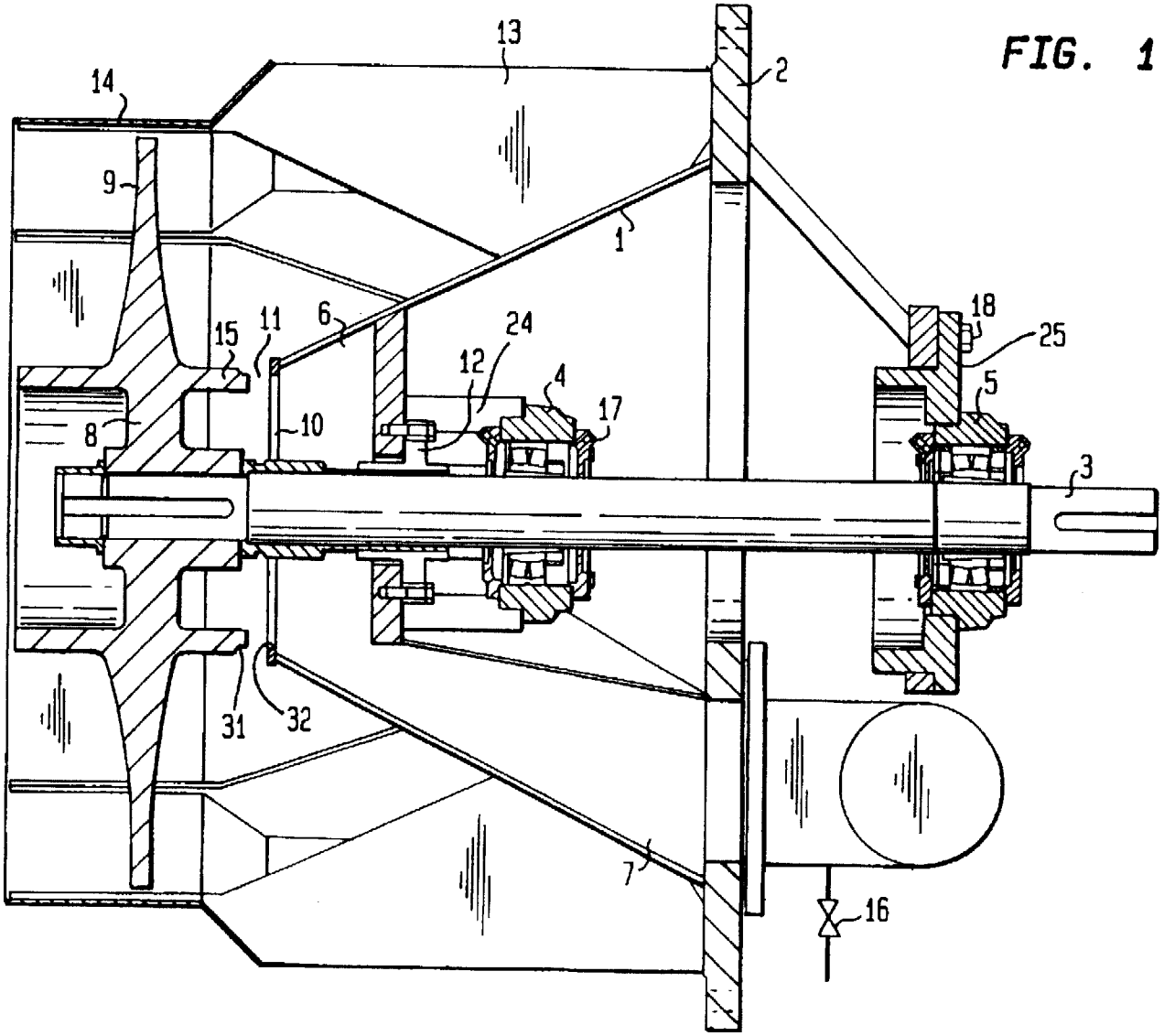
FIG. 1 is a side, sectional view of a mixing apparatus in accordance with the present invention in its operating position.
Figure 2:
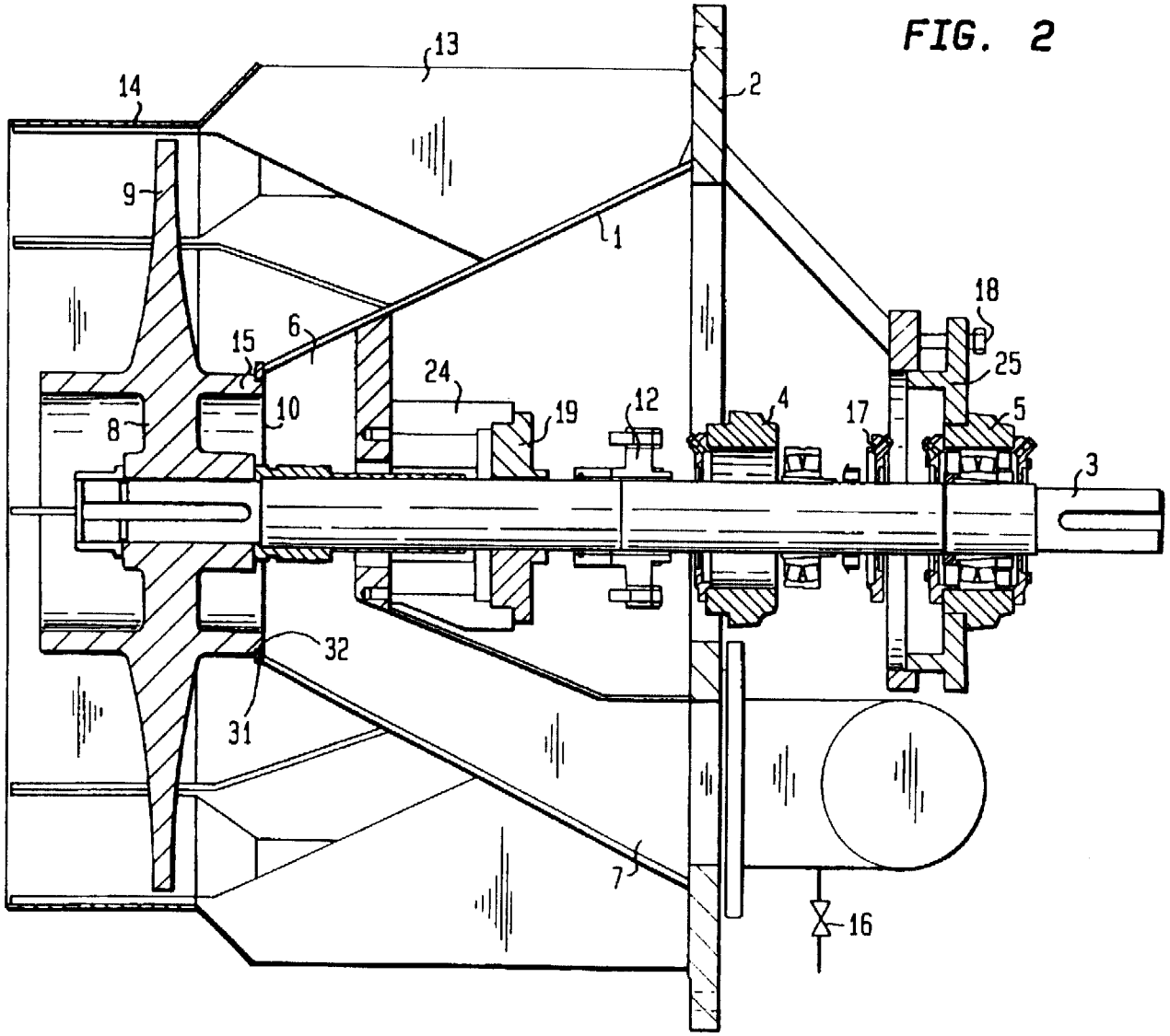
FIG. 2 is a side, sectional view of a mixing apparatus in accordance with the present invention in its sealed position.

Referring to the Figures, in which like reference numerals refer to like elements thereof, the mixing device preferably comprises a conical housing 1 with a flange 2 intended to be attached to the wall in the lower portion of a vessel for the pulp suspension with which the processing medium is to be admixed. In the housing 1, a rotary shaft 3 is located, which is supported by a front bearing 4 and a rear bearing 5. Each bearing comprises a bearing housing containing a bearing. In the front portion of the housing 1, there is located a supply chamber 6 with a connection for the supply of processing medium. The shaft 3 extends through the housing 1 and chamber 6 into the vessel, where it is provided with a hub 8 for a propeller 9. The shaft 3 is driven by a motor (not shown) located outside the vessel.

The supply chamber 6 has an annular opening 10 facing toward the vessel, whereby a gap 11 is defined between the hub 8 and housing 1, through which the processing medium is introduced into the vessel behind the propeller 9. A seal 12, preferably a mechanical seal, is provided about the shaft 3 in the passage from the rear portion of the housing 1 leading into the chamber 6.

The front portion of the housing 1, which is intended to extend into the vessel, includes a number of guide bars 13 attached thereto. The guide bars 13 are substantially radial and constitute means for holding a nozzle 14 located about the propeller 9. The guide bars are intended to prevent the pulp from being carried along in the rotation in the inlet to the nozzle 14. This increases the throw length of the pulp jet, which due to the high-speed rotation of the propeller 9 leaves the nozzle 14. At the same time, the through flow increases and results in a highly efficient admixing.

An extending portion 15 of the hub 8 is formed with a sealing surface 31 which is intended to cooperate with a corresponding sealing surface 32 on the housing 1 when the shaft 3 is at rest or in its sealed position. Due to the shaft 3 being axially movable, a sealing closure of the gap 11 can be established by the cooperating sealing surfaces 31,32 of the hub portion 15 and housing 1. These sealing surfaces are also formed so that the hub 8 is centered within the opening 10 in housing 1. This downtime sealing makes it possible for the interior of the housing 1 to be closed off entirely from the vessel, and at the same time the interior of the housing is accessible from the outside for the exchange of shaft bearings and seals while the vessel remains full.

The connection 7 for the supply of processing medium is provided with a valve 16. This valve 16 can be utilized for controlling the tightness of the downtime sealing and in order to flush the chamber 6 clean and to evacuate it.

The rear bearing 5 is mounted in a rear bearing holder 25, which is fitted movably in the housing 1. The front bearing 4 is mounted in a front bearing holder 24 attached to the housing 1. The mechanical seal 12 is attached to the wall which separates the supply chamber 6 from the rear portion of the housing 1.

In order to exchange the bearings 4, 5 and/or seals 12, the screws which hold the rotary portion of the mechanical seal 12 on the shaft 3 are first undone. Thereafter, a rear cover 17 on the bearing 4 is loosened. This renders it possible to move the shaft 3 axially and thereby close the downtime seal. The shaft 3 is thereby drawn rearward by means of a number of screws 18, which move the rear bearing holder 25 with the bearing 5 in an axial direction until the hub portion 15 seals against the housing 1. The rear bearing holder 25 is simultaneously guided radially in the housing 1. The bearing in the front bearing 4 follows along with the shaft 3. The tightness of the downtime sealing is controlled by opening the valve 16.

Thereafter, the front bearing 4 and seal 12 can be loosened and moved rearward on the shaft 3. In order to be able to finish the dismounting and exchange process, the shaft 3 must now be guided upward and be locked in relation to the housing 1. This is effected at the front bearing holder 24 by means of a separate locking element 19, whose object is to fix the shaft 3 both radially and axially. The locking element 19 can consist, for example, of split cylindrical ring replacing the front bearing 4. This split ring is placed in the front bearing holder 24 where it abuts the shaft 3 and has a guide fitting into the bearing holder 24. The split ring is tightened in the bearing holder 24 and on the shaft 3 by means of screws or the like. Alternatively, the locking element 19 can have a simpler design, for example a split clamp which is attached to the shaft 3 and thereafter on the bearing holder 24.

By fixing the shaft 3 in this way in a rear position with closed downtime sealing, both bearings 4, 5 and the seal 12 can be dismounted. Corresponding new or renovated details are then mounted in reverse order.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. An apparatus for mixing a processing medium with a suspension contained in a vessel comprising: a housing adapted for attachment to a wall of said vessel, said housing including an opening, a rotary shaft extending through said opening in said housing into said vessel, bearing means supporting said rotary shaft within said housing, sealing means for sealing said rotary shaft within said housing, a propeller including a hub attached to said rotary shaft within said vessel, said hub including a sealing portion adopted for sealingly engaging said opening in said housing, said rotary shaft being axially movable between a normal operating position wherein said hub and said opening in said housing are separated by a gap and a sealed position wherein said gap is closed and said sealing portion of said hub sealingly engages said opening in said housing, and locking means for locking said rotary shaft in said sealed position, said locking means comprising a split cylindrical ring for guiding and locking said rotary shaft whereby said locking means can support said rotary shaft in place of said bearing means when said rotary shaft is in said sealed position and whereby when said rotary shaft is locked in said sealed position, said housing is accessible and said bearing means and said sealing means may be maintained or replaced while said vessel remains filled with said suspension.

2. The apparatus of claim 1 wherein said housing includes processing medium supply means for supplying said processing medium to said gap.

3. The apparatus of claim 2 wherein said processing medium supply means includes a supply chamber surrounding said rotary shaft adjacent to said opening in said housing.

4. The apparatus of claim 3 wherein said processing medium supply means includes a valve whereby said supply means can be cleaned and said supply chamber can be evacuated so that the tightness of said seal between said sealing portion of said hub and said opening in said housing can be controlled.

5. The apparatus of claim 1 wherein said bearing means includes front bearing means proximate to said opening in said housing and rear bearing means distal to said opening in said housing.

6. The apparatus of claim 5 wherein said rear bearing means is axially movable within said housing along with said rotary shaft.

7. The apparatus of claim 6 wherein said rear bearing means includes rear bearing holding means for mounting said rear bearing means, said rear bearing holding means being axially movable with said rear bearing means.

8. The apparatus of claim 1 wherein said sealing portion of said hub and said opening in said housing include corresponding sealing surfaces, whereby when said rotary shaft is in said sealed position said corresponding sealing surfaces assist in centering said rotary shaft within said housing.

9. An apparatus for mixing a processing medium with a suspension contained in a vessel comprising: a housing adapted for attachment to a wall of said vessel, said housing including an opening, a rotary shaft extending through said opening in said housing into said vessel, bearing means supporting said rotary shaft within said housing, sealing means for sealing said rotary shaft within said housing, a propeller including a hub attached to said rotary shaft within said vessel, said hub including a sealing portion adopted for sealingly engaging said opening in said housing, said rotary shaft being axially movable between a normal operating position wherein said hub and said opening in said housing are separated by a gap and a sealed position wherein said gap is closed and said sealing portion of said hub sealingly engages said opening in said housing, and locking means for locking said rotary shaft in said sealed position, said locking means comprising a split clamp which is attached to said rotary shaft and, thereafter, supported within said housing, whereby said locking means can support said rotary shaft in place of said bearing means when said rotary shaft is in said sealed position and whereby when said rotary shaft is locked in said sealed position, said housing is accessible and said bearing means and sealing means may be maintained or replaced while said vessel remains filled with said suspension.

10. The apparatus of claim 9 wherein said housing includes processing medium supply means for supplying said processing medium to said gap.

11. The apparatus of claim 10 wherein said processing medium supply means includes a supply chamber surrounding said rotary shaft adjacent to said opening in said housing.

12. The apparatus of claim 11 wherein said processing medium supply means includes a valve whereby said supply means can be cleaned and said supply chamber can be evacuated so that the tightness of said seal between said sealing portion and said hub and said opening in said housing can be controlled.

13. The apparatus of claim 9 wherein said bearing means includes front bearing means proximate to said opening in said housing and rear bearing means distal to said opening in said housing.

14. The apparatus of claim 13 wherein said rear bearing means is axially moveable within said housing along with said rotary shaft.

15. The apparatus of claim 14 wherein said rear bearing means includes rear bearing holding means for mounting said rear bearing means, said rear bearing holding means being axially moveable with said rear bearing means.

16. The apparatus of claim 9 wherein said sealing portion of said hub and said opening in said housing include corresponding sealing surfaces, whereby when said rotary shaft is in said sealed position said corresponding sealing surfaces assist in centering said rotary shaft within said housing.

* * * * *